US006342112B1

(12) United States Patent
Barlat et al.

(10) Patent No.: US 6,342,112 B1
(45) Date of Patent: Jan. 29, 2002

(54) A1-MG BASED ALLOY SHEETS WITH GOOD PRESS FORMABILITY

(75) Inventors: Frederic Barlat, Export; John C. Brem, New Kensington, both of PA (US); Shigeo Hattori; Yasuhiro Havashida, both of Hyogo (JP); Daniel J. Lege, West Leechburg, PA (US); Kwansoo Chung, Seoul (KR); Yasushi Maeda, Hyogo; Kuniaki Matsui, Tochigi, both of (JP); Shawn J. Murtha, Monroeville, PA (US); Masahiro Yanagawa, Hyogo (JP); Narikazu Hashimoto, Tokyo (JP)

(73) Assignees: Alcoa Inc., Pittsburgh, PA (US); Kobe Steel Ltd., Hyogo (JP)

( * ) Notice: Subject to any disclaimer, the term of this patent is extended or adjusted under 35 U.S.C. 154(b) by 0 days.

(21) Appl. No.: 09/619,523

(22) Filed: Jul. 19, 2000

Related U.S. Application Data

(62) Division of application No. 09/384,016, filed on Aug. 26, 1999, now Pat. No. 6,117,252.

(60) Provisional application No. 60/098,860, filed on Sep. 2, 1998.

(51) Int. Cl.[7] ..... C22C 21/06

(52) U.S. Cl. ..... 148/439; 148/440; 420/535; 420/543; 420/545; 420/547

(58) Field of Search ..... 148/437, 438, 148/439, 440, 415, 416, 417, 418; 420/535, 543, 545, 547

(56) References Cited

U.S. PATENT DOCUMENTS 5,605,586 A * 2/1997 Bekki et al. ..... 148/549

FOREIGN PATENT DOCUMENTS

| | | |
|---|---|---|
| JP | 04-308055 | * 10/1992 |
| JP | 05-295476 | * 11/1993 |
| JP | 08-325663 | * 12/1996 |

* cited by examiner

*Primary Examiner*—Roy V. King
*Assistant Examiner*—Janelle Combs-Morillo
(74) *Attorney, Agent, or Firm*—Thomas R. Trempus

(57) ABSTRACT

An Al—Mg based alloy sheet product in which the crystallographic texture exhibits a ratio of the volume fraction of grains in the S orientation {123}<634> to the volume fraction of grains in the CUBE orientation {100}<001> (S/Cube) being 1 or more, and is comprised of grains with a volume fraction of about 10% or less in the GOSS orientation {110}<001>, wherein the grain size is in a range of about 20 to 100 μm demonstrates good formability.

2 Claims, 1 Drawing Sheet

A1-MG BASED ALLOY SHEETS WITH GOOD PRESS FORMABILITY

RELATED APPLICATIONS

This application is a division of application Ser. No. 09/384,016, filed Aug. 26, 1999, now U.S. Pat. No. 6,117, 252, which claims the benefit of U.S. Provisional Application No. 60/098,860, filed Sep. 2, 1998.

BACKGROUND OF THE INVENTION

1. Scope of the Invention

The present invention relates to Al—Mg based alloy sheets with good press formability, more specifically, excellent stretchability, superb deep drawability and high forming limits in the uniaxial tension to plane strain tension region. These Al—Mg based alloy sheets are suitable for automotive applications and the like.

2. Description of the Prior Art

From the consideration of recent concerns for the global environment, social demands toward reducing the weight of automobiles to reduce fuel consumption have escalated. To satisfy such demands, the application of aluminum materials to replace steel sheet for automotive parts has been investigated.

While aluminium alloy sheets have strengths at almost the same level as those of conventional steel sheets, they are generally poorer in press formability such as deep drawability and stretchability. As a result, the improvement of aluminium alloy sheets in terms of press formability has been strongly demanded by automotive manufacturers.

Conventionally, aluminum alloy materials of the Al—Mg series, such as JIS 5052 alloy or JIS 5182 alloy, and the Al—Mg based alloy material disclosed in Japanese Patent Laid-open No. Sho 52-141409, have been used for applications requiring excellent press formability. The present inventors have made investigations and conducted research, development, and merchandising, which led to the development of KS5030 alloy and KS5032 alloy (both under the trade names of Kobe Steel, Co.; the contents thereof are disclosed in Japanese Patent Laid-open Nos. Sho 60-125346, Sho 63-89649, Hei 2-269937 and Hei 3315486). These alloys are characterized as having high strength and high ductility due to the addition of a relatively high amount of Mg. These alloys have enhanced mechanical properties after painting and curing and better stress corrosion cracking resistance through the addition of Cu at about 0.5 wt. %. Additionally, these alloys have optimum grain sizes through the addition of Mn and Cr. These aluminium alloy sheets are used to make automotive parts and the like.

However, the formability of these aluminium based alloy sheets is not satisfactory for many applications, so automobile manufacturers have demanded further improvements in formability. One of the reasons why the formability is insufficient is because aluminium's plastic anisotropy cannot be controlled well. No attention has been paid toward crystallographic texture control as a means to influence the plastic anisotropy of JIS alloys such as JIS 5182 or Al—Mg based alloys disclosed in Japanese Patent Laid-open Nos. Sho 52-141409, Sho 60-125346, Sho 63-89649, Hei 2-269937 and Hei 3-315486 wherein, only the chemical compositions of these alloys are specified. Hence, the formability is insufficient.

It has traditionally been known that crystallographic texture is an important nicrostructural feature in the control of the formability. It is known that the deep drawability of cold-rolled steel sheets can be improved by promoting a {111} texture, i.e., the normals of {111} crystallographic planes are nearly parallel to the sheet normal direction. It has been proposed in recent years that the formability of aluminium alloys can also be improved by controlling the crystallographic texture. For example, Japanese Patent Laid-open No. Hei 5-295476 discloses an Al—Mg based alloy sheet, wherein the volume fraction of the {110} texture (grains with {110} crystallographic planes nearly parallel to the sheet plane) is 10% or more, the ratio of the volume fraction of the {110} texture to the volume fraction of the {112} texture is 1.5 or more, and the grain size is the range of 35 to 80 μm. However, the crystallographic texture disclosed therein is not optimum for deep drawing.

The Al—Mg alloy disclosed in Japanese Patent Laid-open No. Hei 8325663 was developed with attention focused on stretchability, while no consideration was paid to the grain structure which largely controls the drawability. Therefore, the alloy cannot achieve satisfactory press formability.

In an academic paper, by using computer simulations based on the theory of plastic deformation, P. Ratchev et al. made an assumption about the relationship between the crystallographic texture of Al—Mg alloy sheet and formability. He reported that a crystallographic texture with a strong Cube orientation might result in greater anisotropy, leading to the reduction of the formability (Texture and Microstructures, Vol.22, p.219, 1994).

OBJECTIVES OF THE INVENTION

It is the objective of the present invention to provide optimum Al—Mg based alloy sheets with excellent press formability by adjusting the volume fraction of various crystallographic texture components to control plastic anistropy, and by adjusting the type and amount of additional alloying elements to specific ranges in order to optimize grain size. Control of grain size and orientations should enhance the following three components of press formability:

1. stretchability;
2. deep drawability; and
3. forming limits between and including uniaxial tension and plane strain tension modes of deformation.

SUMMARY OF THE INVENTION

First, an Al—Mg based alloy sheet with good stretchability is generally achieved when its crystallographic texture is comprised of a volume fraction of grains around the CUBE* orientation in the range of 5 to 20%, a volume fraction of grains around the GOSS* orientation in the range of 1 to 5%, a volume fraction of grains around each of the BRASS*, S* and COPPER* orientations in the range of 1 to 10% and an average grain size in the range of about 20 to 70 μm. Preferably, the texture is comprised of a volume fraction of grains around the CUBE orientation in the range of 5 to 15%, a volume fraction of grains around the GOSS orientation in the range of 1 to 3%, a volume fraction of grains around each of the BRASS, S and COPPER orientations in the range of 1 to 5%, and an average grain size in a range of 30 to 60 μm.

*Defined in the Detailed Description of the Invention.

Secondly, an Al—Mg based alloy sheet with good deep drawability is generally achieved when the ratio of the volume fraction of grains around the S orientation to the volume fraction of grains around the CUBE orientation (S/Cube) is 1 or more, when the volume fraction of grains around the GOSS orientation is 10% or less, and when the average grain size is in the range of about 20 to 100 μm. Preferably, the ratio of the volume fraction of grains around the S orientation to the volume fraction of grains around the CUBE orientation (S/Cube) is 2 or more, the volume fraction of grains around the GOSS orientation is 5% or less and the average grain size is in the range of 40 to 80 μm.

Finally, an Al—Mg based alloy sheet with higher forming limits in the region between uniaxial tension and plane strain tension region is generally achieved when the crystallographic texture is comprised of a volume fraction of grains around the CUBE orientation in the range of 30 to 50%, a volume fraction of grains around the BRASS orientation in the range of 10 to 20%, wherein the average grain size is in the range of 50 to 100 μm. Preferably, the crystallographic texture is comprised of a volume fraction of grains around the CUBE orientation in the range of 40 to 50% and a volume fraction of grains around the BRASS orientation in the range of 15 to 20%, wherein the average grain size is in a range of 60 to 90 μm.

Furthermore, all of these Al—Mg based alloy sheets have a composition preferably containing between 2 and 6 wt. % Mg and 0.03 wt. % or more in total of Fe, Mn, Cr, Zr, and/or Cu. (If Cu is added, it should be at 0.2 wt. % or more.) The balance of the composition is Al.

By appropriately controlling the crystallographic texture, grain size, and additional elements in Al—Mg based alloy sheets as described above, the press formability can be improved. More specifically, aluminium alloy sheets with excellent stretchability, deep drawability and/or with high forming limits in the region between uniaxial and plane strain tension can be achieved. These aluminium alloy sheets can be used preferably for automotive parts and the like.

BRIEF DESCRIPTION OF THE DRAWINGS

The above as well as other features and advantages of this invention can be more fully appreciated through consideration of the detailed description of the preferred embodiment in conjunction with the accompanying drawings in which.

DETAILED DESCRIPTION OF THE INVENTION

Figure 1:
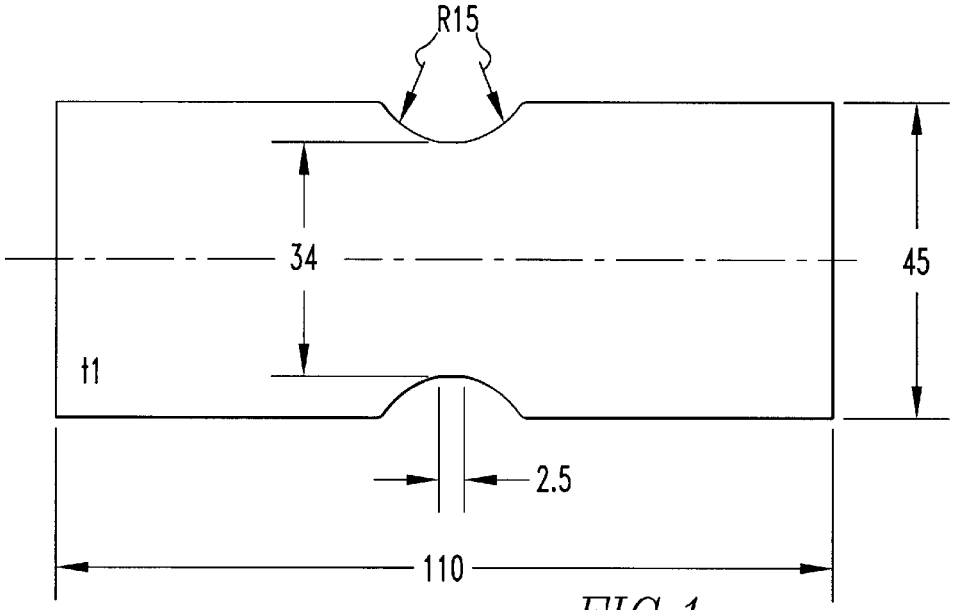
FIG. 1 is a schematic illustration of a plane strain tensile test specimen.

In general, aluminum alloy sheets have a crystallographic texture principally comprised of grains around the CUBE, GOSS, BRASS, S, and COPPER orientations. The relative volume fractions of grains with these different orientations influence plastic anistropy. For a sheet material produced by rolling, grain orientations are expressed with respect to a coordinate system defined by the sheet surface and the rolling directions. The crystallographic planes which are parallel to the sheet surface and the crystallographic directions which are parallel to the rolling direction define the grain orientation. The Miller indices of these particular planes are expressed with curly brackets {hkl} while the indices of these particular directions are expressed with angle brackets <uvw>. For the CUBE, GOSS, BRASS, S and COPPER orientations, these indices are:

CUBE orientation $\{100\}\langle 001\rangle$

GOSS orientation $\{110\}\langle 001\rangle$

BRASS orientation $\{110\}\langle 1\bar{1}2\rangle$

S orientation $\{123\}\langle 63\bar{4}\rangle$

COPPER orientation $\{112\}\langle 11\bar{1}\rangle$

A grain orientation is classified as a particular texture component type if its misorientation from that of an ideal orientation (e.g., CUBE, GOSS, BRASS, S and COPPER) is less than 10 degrees. Orientations other than those defined above are considered to be random orientations.

The present inventors have described the optimum crystallographic texture necessary to enhance stretchability, deep drawability and the forming limits between the uniaxial and plane strain tension regions, on the basis that plastic anisotropy can be reduced by modifying the crystallographic texture. Description of each of the formability characteristics will now be made.

1. Relationship between stretchability and crystallographic texture

Excellent stretchability which means high resistance to strain localization (necking) under biaxial stress conditions can be achieved by optimizing three material characteristics: weak plastic anisotropy, high work-hardening exponent (n value), and a high value of the strain rate sensitivity parameter (m value). It has been known conventionally that an annealed material with weak crystallographic texture has excellent stretchability, but it is impossible to produce a sheet with a completely isotropic crystallographic texture (random grain orientation distribution) by rolling and recrystallization.

A large number of experiments were conducted to study the relationships between stretchability and grain volume fractions for various texture components. It was found that excellent stretchability can be achieved when deforming an Al—Mg sheet material that contains a volume fraction of CUBE oriented grains of about 5% to 20% (preferably 15% or less); a volume fraction of GOSS oriented grains of about 1% to 5% (preferably 3% or less); and a volume fraction of BRASS, S and COPPER oriented grains of about 1% to 10% each (preferably 5% or less).

The quantitative assessment of crystallographic texture was done by measuring the orientations of at least 100 grains using an electron channeling pattern method (electron back scattering method). Grains which were in the CUBE, GOSS, BRASS, S, and COPPER orientations were identified. Grains which were not within 10% of one of these five orientations were considered to be randomly oriented. By subsequently measuring the size of the grains in each orientation (including random orientation) and calculating the approximate volume of each grain based on its measured size, the volume fraction of each grain orientation was determined by summing the volumes for any given orientation and dividing that sum by the total volume of grains. This method for quantitative assessment of the crystallographic texture was used for all claims made in this invention record.

2. Relationship between deep drawability and crystallographic texture

Excellent deep drawability means that when a punch moves into a die cavity to form a useful shape (typically that of a cup) the sheet material can be plastically deformed in the flange without fracturing along the sidewall or the bottom of the deep drawn part. It is required, therefore, that plastic deformation occurs at a low flow stress level in the flange where the stress state is compressive in the circumferential and normal directions, and at a high flow stress level in the sidewall where the stress state is tensile in both circumferential and radial directions.

The present inventors have studied the relationship between the crystallographic texture and LDR (limiting drawing ratio) which is the indicator of deep drawability. The LDR is the ratio of the diameter of the largest blank which can be successfully drawn without fracture to the punch diameter. Higher LDR values are indicative of better deep drawability. The inventors have observed the following findings with respect to the influence of crystallographic texture on LDR:

a. the CUBE and GOSS orientations reduce the LDR;

b. the S orientation improves LDR; and c. the influences of other orientations are negligible.

Among the findings a to c, finding b has conventionally been known (reported in a paper written as a requirement for an academic degree by one of the present inventors). The other two findings, based on the experimental results, are new. Excellent deep drawability, as characterized by the LDR, can be achieved provided that the ratio of the volume fraction of the S texture to the volume of the CUBE texture (S/Cube) is 1 or more, preferably 2 or more, and that the volume fraction of the GOSS texture is about 10% or less, preferably 5% or less. The aluminium alloy previously recommended for deep drawing forming applications, as described in Japanese Patent Laid-open No. Hei 5-295476, is different from the present invention. In the previous patent, the {110} texture (which includes the GOSS and BRASS orientations) has a volume fraction of 10% or more and a ratio of the volume fraction of grains with the {110} orientation to the volume fraction of grains with the {112} orientation (which includes the COPPER orientation) that is 1.5 or more, wherein no definition of the S orientation is provided and, therefore, no grain volume fraction ratios between the S and CUBE orientations (S/Cube) were specified.

3. Relationship between crystallographic texture and the forming limits between the uniaxial tension and plane strain tension states.

As a consequence of various investigations made by the present inventors, it has been verified that the forming limits for strain paths between uniaxial tension and plane strain tension are not affected by plastic anisotropy but are controlled by the material's work-hardening behavior and strain rate sensitivity. However, the work-hardening behavior improves as the intensity of certain crystallographic texture components increases.

It was observed that the crystallographic texture which increases the forming limits between the uniaxial and plane strain stress states contains a volume fraction of CUBE grains in the range of 30% or more (preferably between 40% and 50%) and a volume fraction of BRASS grains of 10% or more (preferably between 15% and 20%).

4. Relationship between press formability and grain size a. Stretchability

The grain size was determined by measuring the mean section length using the grain intercept method on photomicrographs (magnification ×100) and is defined as the mean grain size. All grain size measurements were done on a plane normal to the rolling plane and parallel to the rolling direction. The same method was used to define grain size throughout this invention record.

Materials with smaller grain sizes deform more uniformly and result in higher values of the strain rate sensitivity parameter, which improves stretchability.

As a consequence of the investigations by the present inventors, it has been found that the grain size is optimal within a range of 20 μm or more, preferably between 30 μm and 70 μm (optimally 60 μm). Below a grain size of 20 μm, stretcher strain surface marks develop, while intergranular fracture occurs for grain sizes above 70 μm. Both behaviors are undesirable during forming.

b. Deep drawability

Deep drawability is excellent when the grain size is within a range of about 20 μm or more, preferably between 40 μm and 100 μm (optimally 60 μm). Below a grain size of 20 μm stretcher strain marks typically occur on the bottom of drawn products, which deteriorate their appearance. For grain sizes above 100 μm, orange peel (rough topography) occurs on the surface of the sheet, which also deteriorates the appearance of the products.

c. Forming limits in the region between uniaxial tension and plane strain tension It has been known that the forming limits in this regime are controlled by the work-hardening behavior and strain rate sensitivity of aluminum. Plastic anisotropy and work-hardening behaviors are influenced by the crystallographic texture. The data suggests that a larger grain size improves work-hardening ability. However, large grain sizes are responsible for orange peel (roughening) that occurs during forming, which prominently deteriorates the appearance of the resulting product.

Forming limits increase in the region between uniaxial tension and plane strain tension provided that the grain size is within a range of about 50 μm to 100 μm, preferably between about 60 μm and 90 μm.

5. Chemical composition

Alloying elements largely influence crystallographic texture formation and modify plastic anisotropy. Therefore, the crystallographic texture can be optimized by controlling the elements that are added to Al alloys as well as by the processes that are employed during fabrication.

For these reasons, the chemical composition of the aluminium alloy of the present invention should include Mg content between 2 and 6 wt % and one or more of the alloying elements selected from Fe, Mn, Cr, Zr and Cu at 0.03 wt % or more in total (at 0.2 wt % or more of Cu when Cu is selected), wherein the upper limit of the content for each element is preferably as follows: Fe≦0.2 wt %; Mn≦0.6 wt %; Cr≦0.3 wt %; Zr≦0.3 wt % and Cu≦1.0%.

Mg is an important element that enhances work-hardening behavior, which in turn, causes uniform plastic deformation and greater forming limit strains. If the Mg content is below 2 wt %, the hardening of the Mg-containing product is insufficient; if the Mg content is above 6 wt %, rolling is difficult and additionally, intergranular fracture readily develops during forming. Hence, the Mg content is preferably within a range of about 2 to 6 wt %.

The additions of Fe, Mn, Cr, and Zr modify crystallographic texture and refine grain size which decreases intergranular failure that occurs in materials with larger grain sizes. Additionally, these elements can improve strain rate sensitivity and thereby increase forming limits. A positive m value (strain rate sensitivity parameter) means that higher stresses are needed to deform a material that is being deformed at a faster strain rate (necked regions in deformed materials, for example). Higher strain rate sensitivity allows a material to distribute strain more uniformly by essentially postponing severe plastic flow localization. However, the enhancements due to strain rate sensitivity are not observed when the total content of Fe, Mn, Cr, and Zr is below 0.03 wt %. Above the upper limit of each element (namely, 0.2 wt % of Fe content, 0.6 wt % of Mn content, 0.3 wt % of Cr content and 0.3 wt % of Zr content), large particles are formed which act as failure initiation points, whereby the formability is deteriorated.

Cu is an element that improves work-hardening behavior, aging response during paint bake, and stress corrosion cracking resistance. Copper additions also can modify the texture of aluminum alloys. Below 0.2 wt % Cu, little or no effect is observed and above 1.0 wt % Cu, large particles are formed which act as failure initiation points, whereby the formability is deteriorated.

6. Crystallographic texture and processing conditions

The aluminium alloy sheet materials of the present invention are produced through standard casting, homogenization, hot rolling, cold rolling and final annealing. The resulting crystallographic texture varies, depending on the chemical composition and the processing conditions employed during fabrication. When the sheet materials contain transition metals such as Mn, Cr, Fe, and Zr, the resulting dispersoid particles should be controlled to some desired size and shape because they influence the grain size and crystallographic texture that evolves during fabrication which, in turn, affects formability. The optimum conditions employed during homogenization vary, depending on the types and amounts of transition metals such as Mn, Cr, Fe and Zr that are added. Therefore, the optimum conditions cannot be absolutely defined.

The optimum conditions for hot rolling and cold rolling vary, depending on the size and shape of dispersoid particles formed during the homogenization process. Hot rolling, warm rolling, cold rolling at high reduction, cold rolling at low reduction and the like are combined together, but the combination thereof cannot be absolutely defined. The optimum rolling conditions vary, depending on how the process is conducted, namely whether or not the material is annealed after hot rolling and whether or not intermediate annealing is performed between cold rolling passes. After cold rolling, final annealing or heat treatment should be conducted to get a recrystallized material whose crystallographic texture depends on the conditions employed during this process step.

For an identical alloy composition the desired crystallographic texture described in the claims can be achieved by controlling the homogenization conditions, rolling conditions, annealing conditions, and annealing/heat treatment process conditions and the like in a complex manner, whereby the press formability can be greatly enhanced. These processing conditions may individually overlap with conventional processing conditions, but a crystallographic texture preferred for the desired formability can be achieved through specific combinations of these conditions.

A crystallographic texture that results in excellent deep drawability is likely to be achieved when the final cold rolling reduction is low. Also, a crystallographic texture that leads to excellent stretchability can be achieved when the final cold rolling reduction is around 50%. The forming limits in the region between uniaxial tension and plane strain tension are more likely to be high when the final cold rolling reduction is high. Herein, the term "final cold rolling reduction" means rolling reduction after annealing when annealing is used during the intermediate stages of cold rolling, and it means cold rolling reduction if no annealing is employed during the intermediate stages of cold rolling.

DETAILED DESCRIPTION OF PREFERRED EMBODIMENTS

EXAMPLE 1

By routine DC casting, an Al—5% Mg—0.1% Fe alloy was prepared by casting an ingot with the following dimensions: 400 mm (width)×150 mm (thickness)×3,000 mm (length). After an homogenization practice of 48 hrs/480° C.+4 hrs/440° C., the ingot was hot rolled to a sheet thickness of 5 mm. The initial hot rolling temperature was 440° C. which was the temperature employed during the homogenization practice described above. The final slab temperature measured during hot rolling was 320° C. After hot rolling, sheet samples were prepared by cold-rolling to a thickness of 1 mm. However, during the intermediate stages of the cold rolling process, intermediate annealing was conducted appropriately, to adjust the final cold rolling reduction within the range of 17% to 80%. When no intermediate annealing was employed, the sheets were directly rolled from 5 mm to 1 mm, so that the final cold rolling reduction was 80%.

After cold rolling, the 1 mm thick sheet samples were annealed/heat treated using the soak and temperature conditions shown in Table 1. Resulting grain sizes and crystallographic textures are also shown in Table 1. Herein, two heating rates to the anneal/heat treat temperature were employed, namely rapid heating (60,000° C./h) and slow heating (300° C./h).

The resulting sheet materials, Nos. 1 to 15 in Table 1, were evaluated for stretchability in the stretch forming test. In this test, 100 mm diameter test pieces are deformed using a 50 mm diameter hemispherical punch. The strain near the fracture location, the failure strain, was determined by measuring the dimensional changes of a 3 mm square grid applied on the surface of the sheet specimen. The results are shown in Table 1, together with the production process parameters (final cold rolling reduction, anneal/heat treat process temperature and retention time, and heating rate), grain size and crystallographic texture.

TABLE 1

Processing conditions, grain size* and crystallographic texture** of samples for stretchability assessment

| No. | Final cold rolling reduction % | Heating rate to anneal/heat treat process ° C./h | Anneal/heat treat temperature (° C.) Retention time at temperature (seconds) | Average grain size (μm) | CUBE orientation volume (%) | GOSS orientation volume (%) | BRASS orientation volume (%) | S orientation volume (%) | COPPER orientation volume (%) | Biaxial test failure strain |
|---|---|---|---|---|---|---|---|---|---|---|
| Examples | | | | | | | | | | |
| 1 | 40 | 60000 | 530<br>10 | 70 | 14 | 3 | 6 | 9 | 8 | 0.40 |
| 2 | 50 | 60000 | 530<br>10 | 57 | 12 | 1 | 1 | 5 | 6 | 0.40 |
| 3 | 60 | 60000 | 530<br>10 | 32 | 5 | 3 | 2 | 6 | 7 | 0.41 |

TABLE 1-continued

Processing conditions, grain size* and crystallographic texture** of samples for stretchability assessment

| No. | Final cold rolling reduction % | Heating rate to anneal/heat treat process ° C./h | Anneal/heat treat temperature (° C.) Retention time at temperature (seconds) | Average grain size (μm) | CUBE orientation volume (%) | GOSS orientation volume (%) | BRASS orientation volume (%) | S orientation volume (%) | COPPER orientation volume (%) | Biaxial test failure strain |
|---|---|---|---|---|---|---|---|---|---|---|
| 4 | 40 | 60000 | 400<br>1800 | 68 | 20 | 4 | 7 | 10 | 7 | 0.39 |
| 5 | 50 | 60000 | 400<br>1800 | 41 | 15 | 5 | 10 | 9 | 8 | 0.40 |
| 6 | 60 | 60000 | 400<br>300 | 20 | 15 | 3 | 4 | 8 | 10 | 0.41 |
| Comparative Examples | | | | | | | | | | |
| 7 | 17 | 60000 | 530<br>6 | 49 | 22 | 0 | 7 | 29 | 8 | 0.35 |
| 8 | 17 | 60000 | 400<br>600 | 20 | 32 | 6 | 6 | 32 | 7 | 0.33 |
| 9 | 17 | 300 | 400<br>60 | 50 | 18 | 7 | 13 | 13 | 11 | 0.32 |
| 10 | 80 | 60000 | 530<br>6 | 45 | 35 | 0 | 5 | 7 | 9 | 0.36 |
| 11 | 80 | 60000 | 530<br>10 | 49 | 37 | 0 | 10 | 11 | 8 | 0.34 |
| 12 | 80 | 60000 | 400<br>1800 | 30 | 45 | 0 | 11 | 12 | 6 | 0.32 |
| 13 | 80 | 300 | 400<br>60 | 46 | 27 | 3 | 14 | 16 | 6 | 0.30 |
| 14 | 50 | 60000 | 400<br>60 | 18 | 18 | 5 | 10 | 7 | 7 | 0.40<br>ss mark developed |
| 15 | 17 | 300 | 530<br>30 | 81 | 24 | 3 | 9 | 16 | 12 | 0.37 |

*Grain size was measured on a face normal to the rolling plane and parallel to the rolling direction by linear intercept method.
**Orientations of 100 grains were determined by electron channeling pattern method.

Table 1 indicates that the failure strains exceeded 0.38 in all of the examples of the present invention, but the failure strains were below 0.38 in all but one (No. 14) of the comparative examples. While the failure strain of Comparative Example No. 14 was above 0.38, the sample exhibited stretcher strain (ss) marks. The data in Table 1 shows that the sheet materials of the present invention have better stretchability than that of the materials represented by the comparative examples.

EXAMPLE 2

An Al—5% Mg—0.1% Fe alloy was prepared by first casting a DC ingot with the following dimensions: 400 mm (width)×150 mm (thickness)×3000 mm (length). After an homogenization practice of 48 hrs/520° C.+4 hrs/460° C. the ingot was hot rolled to a sheet thickness of 5 mm. The initial hot rolling temperature was 460° C., while the final slab temperature measured during hot rolling was 330° C. After hot rolling, the sheet was cold rolled to 1 mm. During the intermediate stages of cold rolling, intermediate annealing was appropriately conducted, to adjust the final cold rolling reduction within a range of 17% to 80%. When no intermediate annealing was done during cold rolling; the sheet was directly rolled from 5 mm to 1 mm, so that the final cold rolling reduction was 80%.

The 1 mm thick sheets were then annealed/heat treated according to the soak/temperature conditions shown in Table 2 (Nos. 21–28). The resulting grain sizes and crystallographic textures are also shown in Table 2. Furthermore, heat-up rates during the final thermal processes were conducted in two fashions; namely rapid heating (60,000° C./h) and slow heating (300° C./h).

The limiting drawing ratio (LDR) of the resulting sheet materials (Nos. 21 to 28) were experimentally measured as follows: test blanks of various diameters were prepared and deep drawn into flat-bottom cups using a 50 mm diameter punch and a blankholder force (BHF) of 5 kn. The other pertinent test parameters are listed below. The LDR is defined as the ratio of the diameter of the largest blank which formed a fracture-free cup to the punch diameter. A larger limiting drawing ratio indicates better deep drawability. Herein, a solid lubricant KS-3 (developed by Kobe Steel Co.) was used for these measurements.

Measuring conditions for the LDR test

Die material: SKD 11

Punch diameter: 50 mm (flat head)

Die opening diameter: 52.8 mm

Die shoulder radius: 6.0 mm

Blank holder force: 5 kn

Punch speed: 850 mm/min.

Table 2 shows the limiting drawing ratio (LDR), together with the final cold rolling reduction, heating rate, annealing/heat treatment temperature and retention time, grain size, and crystallographic texture (the ratio of the volume fraction of grains in the S orientation to the volume fraction of grains in the CUBE orientation (S/CUBE) and the volume fraction of grains in the GOSS orientation) for each example of the present invention and comparative example samples.

TABLE 2

Processing conditions, grain size* and crystallographic texture** of samples for drawability assessment

| No. | Final cold rolling reduction % | Heating rate to anneal/heat treat process ° C./h | Anneal/heat treat temperature (° C.) Retention time at temperature (seconds) | Average grain size (μm) | CUBE orientation volume (%) | S orientation volume (%) | GOSS orientation volume (%) | Ratio of S orientation to CUBE orientation volume (%) | Measured LDR |
|---|---|---|---|---|---|---|---|---|---|
| Examples | | | | | | | | | |
| 21 | 17 | 60000 | 530<br>10 | 68 | 24 | 34 | 0 | 1.4 | 2.15 |
| 22 | 17 | 60000 | 400<br>600 | 20 | 32 | 32 | 6 | 1.0 | 2.10 |
| 23 | 17 | 300 | 400<br>3600 | 100 | 22 | 37 | 10 | 1.7 | 2.08 |
| Comparative Examples | | | | | | | | | |
| 24 | 50 | 60000 | 530<br>10 | 57 | 12 | 5 | 1 | 0.4 | 1.96 |
| 25 | 50 | 300 | 400<br>1800 | 87 | 19 | 12 | 3 | 0.6 | 2.00 |
| 26 | 80 | 60000 | 400<br>3600 | 50 | 44 | 15 | 12 | 0.3 | 1.97 |
| 27 | 17 | 60000 | 400<br>300 | 17 | 29 | 35 | 8 | 1.2 | 2.02<br>ss mark developed |
| 28 | 17 | 300 | 400<br>7200 | 120 | 21 | 33 | 9 | 1.6 | 2.02<br>Orange peel developed |

*Grain size was measured on a face normal to the rolling plane and parallel to the rolling direction by linear intercept method.
**Orientations of 100 grains were determined by electron channeling pattern method.

Table 2 indicates that the sheet materials of the present invention have higher LDRs than those of the comparative examples. This implies that these sheet materials have excellent deep drawability.

EXAMPLE 3

An Al—5% Mg—0.1% Fe alloy was prepared by first casting a DC ingot with the following dimensions: 400 mm (width)×150 mm (thickness)×3000 mm (length). After an homogenization practice of 48 hrs/480° C. the ingot was hot rolled to a sheet thickness of 5 mm. The initial hot rolling temperature was 480° C., while the final slab temperature measured during hot rolling was 340° C. After hot rolling, the sheet samples were cold rolled to 1 mm. However, during the intermediate stages of the cold rolling, intermediate annealing was appropriately conducted, to adjust the final cold rolling reduction within a range of 17% to 80%. When no intermediate annealing was done during cold rolling, the sheet was directly rolled from 5 mm to 1 mm, so that the final cold rolling reduction was 80%.

Following cold rolling, the 1 mm thick sheet material was annealed/heat treated at the temperatures and soak times that are shown in Table 3. The resulting grain sizes and crystallographic textures of these samples (Nos. 31–37) are also shown in Table 3. Furthermore, the two heat-up rates were employed during the anneal/heat treatment, namely rapid heating (60,000° C./h) and slow heating (300° C./h).

Figure 2:
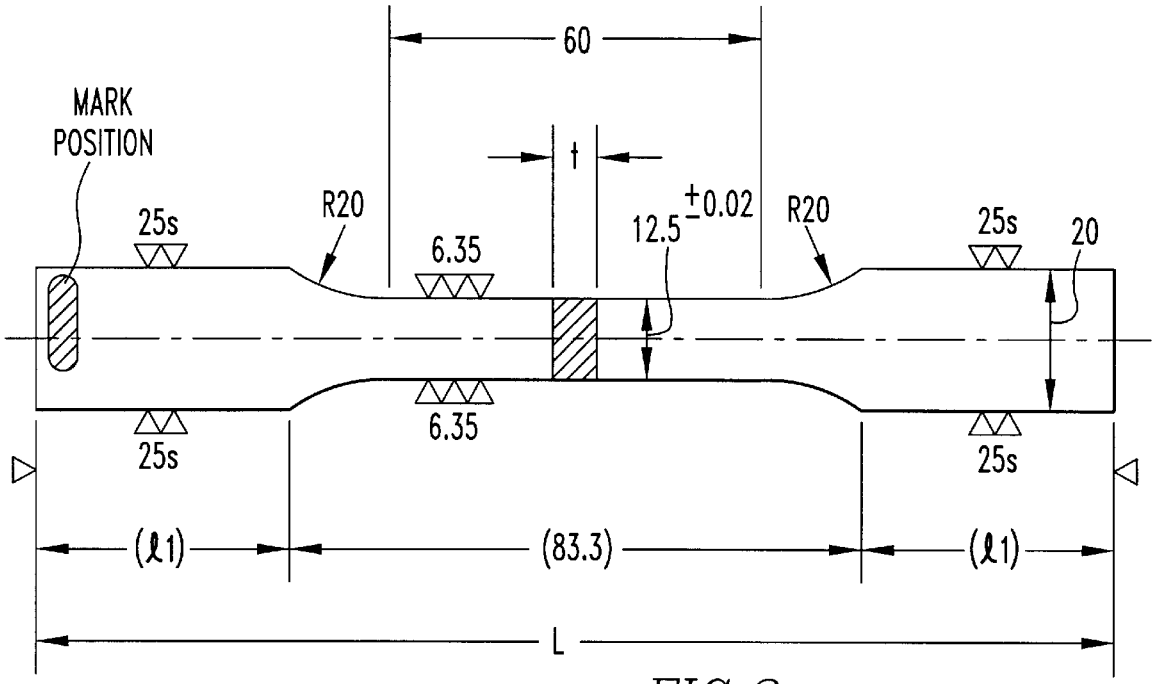
FIG. 2 is a schematic illustration of a uniaxial tensile test specimen.

Using the sheet materials (Nos. 31–37) resulting from the above described processes, plane strain tension and uniaxial tension tests were conducted using specimens with dimensions shown in FIGS. 1 and 2, respectively. For all the specimens, the strains at failure were measured. These strains were calculated by measuring the initial ($l_o$) and final ($l_f$) gauge lengths and using the following relationship: failure strain=$(l_f-l_o)/l_o$.

The failure strain measurements are shown in Table 3, together with the production process parameters (final cold roll reduction, anneal/heat treatment process temperature and retention time, heating rate), grain size and crystallographic texture.

TABLE 3

Processing conditions, grain size* and crystallographic texture** of samples for formability assessment in uniaxial tension and plane strain tension

| No. | Final cold rolling reduction % | Heating rate to anneal/heat treat process ° C./h | Anneal/heat treat temperature (° C.) Retention time at temperature (seconds) | Average grain size (μm) | CUBE orientation volume (%) | BRASS orientation volume (%) | Wide-width tensile test (plane strain) failure strain | Routine tensile test (uniaxial tension) failure strain |
|---|---|---|---|---|---|---|---|---|
| Examples | | | | | | | | |
| 31 | 80 | 60000 | 530 | 100 | 50 | 13 | 0.31 | 0.36 |

TABLE 3-continued

Processing conditions, grain size* and crystallographic texture** of samples for formability assessment in uniaxial tension and plane strain tension

| No. | Final cold rolling reduction % | Heating rate to anneal/heat treat process ° C./h | Anneal/heat treat temperature (° C.) Retention time at temperature (seconds) | Average grain size (μm) | CUBE orientation volume (%) | BRASS orientation volume (%) | Wide-width tensile test (plane strain) failure strain | Routine tensile test (uniaxial tension) failure strain |
|---|---|---|---|---|---|---|---|---|
| | | | 1800 | | | | | |
| 32 | 80 | 60000 | 400 | 50 | 44 | 10 | 0.30 | 0.35 |
| | | | 3600 | | | | | |
| 33 | 80 | 300 | 400 | 56 | 30 | 20 | 0.31 | 0.35 |
| | | | 1800 | | | | | |
| Comparative Examples | | | | | | | | |
| 34 | 50 | 60000 | 530 | 68 | 16 | 2 | 0.28 | 0.33 |
| | | | 30 | | | | | |
| 35 | 17 | 60000 | 530 | 81 | 26 | 8 | 0.28 | 0.32 |
| | | | 60 | | | | | |
| 36 | 80 | 60000 | 530 | 45 | 35 | 5 | 0.28 | 0.33 |
| | | | 6 | | | | | |
| 37 | 80 | 60000 | 530 | 115 | 48 | 7 | 0.30 | 0.35 |
| | | | 3600 | | | | Orange peel developed | Orange peel developed |

*Grain size was measured on a face normal to the rolling plane and parallel to the rolling direction by linear intercept method.
**Orientations of 100 grains were determined by electron channeling pattern method.

Table 3 indicates that the plane strain and uniaxial tension failure strains are all higher for the sheet materials of the present invention than those for the comparative examples, which suggests that these sheet materials have higher forming limits in the region between uniaxial tension and plane strain tension.

EXAMPLE 4

The alloys with the compositions shown in Tables 4 and 5 were prepared by first casting a DC ingot with the following dimensions: 400 mm (width)×150 mm (thickness)×3000 mm (length). Following the homogenization practices shown for these ingots in Tables 4 and 5, the ingots were hot rolled into sheet samples that were 5 mm thick. The initial hot rolling temperature was the same as the temperature employed during the second-step soak for each ingot. The final hot rolling temperature was about 150° C. lower than the initial hot rolling temperature. Following hot rolling, the sheet samples were cold rolled from 5 mm to 1 mm. During the intermediate stages of cold rolling, intermediate annealing was then appropriately conducted, to adjust the final cold rolling reduction to either 50% or 17%. Following cold rolling, the sheet materials were annealed/heat treated at 530° C. The resulting grain sizes and crystallographic textures of these samples (Nos. 41–73), are shown in Tables 4 and 5. Furthermore, the heat-ups to the anneal temperatures were conducted by rapid heating (60,000° C./h)

The resulting sheet materials (Nos. 41–73) were then subjected to stretch forming tests, as described in Example 1. The failure strain measurements are shown in Tables 4 and 5, together with the corresponding production process parameters (final cold rolling reduction, anneal temperature and retention time, heating rate), grain size and crystallographic texture. Table 4 shows the results for examples of the present invention; and Table 5 shows the results of comparative examples.

In the tables, the expression A:B in the two-step homogenization practice means that a test piece is retained at a temperature "A" (° C.) for a duration of time "B" (in hours).

TABLE 4

Composition, processing conditions, grain size* and crystallographic texture** for samples which result in good stretch forming failure strains

| | Composition (% by weight) | | | | | | | | Processing conditions | | | | Crystallographic texture component (volume %) | | | | | |
|---|---|---|---|---|---|---|---|---|---|---|---|---|---|---|---|---|---|---|
| No | Mg | Fe | Mn | Cr | Zr | Cu | Si | Al | Final roll reduction (%) | Homogenization conditions (temp:hours) | Anneal process temperature (° C.) | Average grain size (μm) | CUBE | GOSS | BRASS | S | COPPER | Stretch forming failure strain |
| 41 | 2 | 0.2 | — | — | — | — | <0.05 | Balance | 50 | 480:48 (1st) | 530 | 68 | 14 | 2 | 2 | 7 | 9 | 0.38 |
| 42 | 3 | 0.1 | — | — | — | — | <0.05 | Balance | 50 | ↓ | 530 | 47 | 13 | 1 | 1 | 9 | 7 | 0.39 |
| 43 | 6 | 0.03 | — | — | — | — | <0.05 | Balance | 50 | 440:4 (2nd) | 530 | 50 | 10 | 1 | 2 | 8 | 6 | 0.39 |
| 44 | 5 | — | 0.03 | — | — | — | <0.05 | Balance | 50 | 510:48 (1st) | 530 | 66 | 17 | 5 | 8 | 3 | 3 | 0.39 |
| 45 | 5 | — | 0.2 | — | — | — | <0.05 | Balance | 50 | ↓ | 530 | 38 | 11 | 3 | 8 | 7 | 7 | 0.40 |
| 46 | 5 | — | 0.6 | — | — | — | <0.05 | Balance | 50 | 480:4 (2nd) | 530 | 31 | 7 | 1 | 1 | 2 | 3 | 0.41 |

TABLE 4-continued

Composition, processing conditions, grain size* and crystallographic texture** for samples which result in good stretch forming failure strains

| | Composition (% by weight) | | | | | | | | Processing conditions | | | | Crystallographic texture component (volume %) | | | | | Stretch forming |
|---|---|---|---|---|---|---|---|---|---|---|---|---|---|---|---|---|---|---|
| No | Mg | Fe | Mn | Cr | Zr | Cu | Si | Al | Final roll reduction (%) | Homogenization conditions (temp:hours) | Anneal process temperature (° C.) | Average grain size (μm) | CUBE | GOSS | BRASS | S | COPPER | failure strain |
| 47 | 5 | — | — | 0.03 | — | — | <0.05 | Balance | 50 | 500:48 (1st) | 530 | 58 | 16 | 4 | 9 | 2 | 4 | 0.40 |
| 48 | 5 | — | — | 0.1 | — | — | <0.05 | Balance | 50 | ↓ | 530 | 40 | 12 | 4 | 8 | 8 | 8 | 0.40 |
| 49 | 5 | — | — | 0.3 | — | — | <0.05 | Balance | 50 | 470:4 (2nd) | 530 | 33 | 9 | 2 | 1 | 5 | 7 | 0.41 |
| 50 | 5 | — | — | — | 0.03 | — | <0.05 | Balance | 50 | 490:48 (1st) | 530 | 70 | 11 | 5 | 5 | 7 | 4 | 0.39 |
| 51 | 5 | — | — | — | 0.1 | — | <0.05 | Balance | 50 | ↓ | 530 | 50 | 11 | 4 | 4 | 6 | 5 | 0.40 |
| 52 | 5 | — | — | — | 0.3 | — | <0.05 | Balance | 50 | 460:4 (2nd) | 530 | 39 | 12 | 4 | 3 | 7 | 4 | 0.40 |
| 53 | 5 | — | — | — | — | 0.2 | <0.05 | Balance | 50 | 480:2 (1st) | 530 | 47 | 17 | 1 | 7 | 10 | 7 | 0.39 |
| 54 | 5 | — | — | — | — | 0.5 | <0.05 | Balance | 50 | ↓ | 530 | 48 | 17 | 1 | 7 | 10 | 7 | 0.39 |
| 55 | 5 | — | — | — | — | 1.0 | <0.05 | Balance | 50 | 450:4 (2nd) | 530 | 44 | 13 | 2 | 6 | 7 | 3 | 0.39 |
| 56 | 5 | 0.1 | 0.4 | — | — | — | <0.05 | Balance | 50 | 510:8 (1st) | 530 | 30 | 8 | 2 | 3 | 6 | 4 | 0.42 |
| | | | | | | | | | | ↓ | | | | | | | | |
| 57 | 5.5 | 0.1 | 0.05 | 0.05 | — | 0.3 | <0.05 | Balance | 50 | 460:4 (2nd) | 530 | 35 | 11 | 3 | 7 | 8 | 7 | 0.42 |

*Grain size was measured on a face normal to the rolling plane and parallel to the rolling direction by linear intercept method.
**Orientations of 100 grains were determined by electron channeling pattern method.

TABLE 5

Composition, processing conditions, grain size*, crystallographic texture** and stretch forming failure strains for comparative samples

| | Composition (% by weight) | | | | | | | | Processing conditions | | | | Crystallographic texture component (volume %) | | | | | Stretch forming |
|---|---|---|---|---|---|---|---|---|---|---|---|---|---|---|---|---|---|---|
| No | Mg | Fe | Mn | Cr | Zr | Cu | Si | Al | Final roll reduction (%) | Homogenization conditions (temp:hours) | Anneal process temperature (° C.) | Average grain size (μm) | CUBE | GOSS | BRASS | S | COPPER | failure strain |
| 58 | 1.5 | 0.2 | — | — | — | — | <0.05 | Balance | 50 | 500:4 | 530 | 49 | 24 | 2 | 2 | 8 | 7 | 0.36 |
| 59 | 6.5 | 0.1 | — | — | — | — | <0.05 | Balance | 50 | 500:4 | 530 | 37 | 4 | 0 | 3 | 3 | 2 | 0.35 |
| 60 | 5 | 0.02 | — | — | — | — | <0.05 | Balance | 50 | 500:4 | 530 | 78 | 12 | 1 | 1 | 4 | 5 | 0.37 |
| 61 | 5 | 0.25 | — | — | — | — | <0.05 | Balance | 50 | 500:4 | 530 | 39 | 23 | 3 | 3 | 7 | 2 | 0.34 |
| 62 | 5 | — | 0.02 | — | — | — | <0.05 | Balance | 50 | 500:4 | 530 | 72 | 17 | 5 | 8 | 3 | 3 | 0.35 |
| 63 | 5 | — | 0.7 | — | — | — | <0.05 | Balance | 50 | 500:4 | 530 | 19 | 6 | 1 | 1 | 2 | 3 | 0.32 |
| 64 | 5 | — | — | 0.02 | — | — | <0.05 | Balance | 50 | 500:4 | 530 | 77 | 16 | 4 | 9 | 2 | 4 | 0.35 |
| 65 | 5 | — | — | 0.4 | — | — | <0.05 | Balance | 50 | 500:4 | 530 | 17 | 8 | 2 | 1 | 6 | 6 | 0.30 |
| 66 | 5 | — | — | — | 0.02 | — | <0.05 | Balance | 50 | 500:4 | 530 | 85 | 11 | 5 | 5 | 7 | 4 | 0.34 |
| 67 | 5 | — | — | — | 0.4 | — | <0.05 | Balance | 50 | 500:4 | 530 | 18 | 12 | 4 | 3 | 7 | 4 | 0.34 |
| 68 | 5 | — | — | — | — | 0.1 | <0.05 | Balance | 50 | 500:4 | 530 | 46 | 17 | 1 | 7 | 10 | 7 | 0.35 |
| 69 | 5 | — | — | — | — | 1.1 | <0.05 | Balance | 17 | 500:4 | 530 | 40 | 13 | 2 | 6 | 7 | 2 | 0.29 |
| 70 | 5 | — | 0.4 | — | — | — | <0.05 | Balance | 17 | 500:4 | 530 | 42 | 23 | 3 | 7 | 28 | 7 | 0.36 |
| 71 | 5 | — | — | — | 0.1 | — | <0.05 | Balance | 17 | 500:4 | 530 | 49 | 21 | 1 | 4 | 17 | 8 | 0.33 |
| 72 | 5 | 0.1 | 0.4 | — | — | — | <0.05 | Balance | 17 | 500:4 | 530 | 41 | 19 | 1 | 2 | 21 | 7 | 0.35 |
| 73 | 5.5 | 0.1 | 0.05 | 0.05 | — | 0.3 | <0.05 | Balance | 17 | 500:4 | 530 | 38 | 23 | 2 | 4 | 21 | 8 | 0.36 |

*Grain size was measured on a face normal to the rolling plane and parallel to the rolling direction by linear intercept method.
**Orientations of 100 grains were determined by electron channeling pattern method.

The stretch forming failure strains for the comparative samples were all 0.37 or lower (Table 5), while the stretch forming failure strains for the samples representing the present invention were all 0.38 or higher (Table 4).

EXAMPLE 5

The alloys with the compositions shown in Tables 6 and 7 were prepared by first casting a DC ingot with the following dimensions: 400 mm (width)×150 mm (thickness)×3000 mm (length).

After homogenization using the practices shown in Tables 6 and 7, the ingots were hot rolled to a thickness of 5 mm. The initial hot rolling temperature was the same as the temperature employed during the second step of the homogenization. The final temperature measured during hot rolling was about 150° C. lower than the initial hot rolling temperature mentioned above. Following hot rolling, sheet samples were cold rolled from 5 mm to 1 mm. During the intermediate stages of the cold rolling, intermediate annealing was conducted appropriately or never conducted, to adjust the final cold rolling reductions to 17%, (intermediate annealing) 50% (intermediate annealing) and 80% (no intermediate annealing).

Following cold rolling, the sheet materials were annealed/heat treated at 400 or 530° C. The resulting grain sizes and crystallographic textures of the various samples (Nos.

81–113) are shown in Tables 6 and 7. Herein, the heat-up rates to the anneal temperature were either rapid (60,000° C./h) or slow (300° C./h).

In the same manner as in Example 2, the resulting sheet materials (Nos. 81 to 113) were tested to measure the limiting drawing ratio (LDR). The results of these tests are shown in Tables 6 and 7, together with the production process parameters (final cold roll reduction, anneal temperature and retention time, heating rate), grain size and crystallographic texture. Table 6 shows the results of the samples produced as part of this invention. Table 7 shows the results of comparative samples.

TABLE 6

Composition, processing conditions, grain size* and crystallographic texture** for samples which result in good deep drawability

| | Composition (% by weight) | | | | | | | | Processing Conditions | | | | | Crystallographic texture component (volume %) | | | | |
|---|---|---|---|---|---|---|---|---|---|---|---|---|---|---|---|---|---|---|
| No | Mg | Fe | Mn | Cr | Zr | Cu | Si | Al | Final roll reduction (%) | Homogenization conditions (temp: hours) | Heating rate (° C.) | Anneal process temperature (° C.) | Average grain size (μm) | CUBE | GOSS | S | S/CUBE | Assessment LDR |
| 81 | 2 | 0.2 | — | — | — | — | <0.05 | Balance | 17 | 520:48 | 60000 | 400 | 88 | 28 | 4 | 35 | 1.3 | 2.11 |
| 82 | 3 | 0.1 | — | — | — | — | <0.05 | Balance | 17 | ↓ | 60000 | 400 | 100 | 30 | 3 | 32 | 1.1 | 2.12 |
| 83 | 6 | 0.03 | — | — | — | — | <0.05 | Balance | 17 | 440:4 | 60000 | 400 | 75 | 32 | 2 | 33 | 1.0 | 2.13 |
| 84 | 5 | — | 0.03 | — | — | — | <0.05 | Balance | 17 | 550:48 | 60000 | 400 | 82 | 22 | 5 | 27 | 1.2 | 2.08 |
| 85 | 5 | — | 0.2 | — | — | — | <0.05 | Balance | 17 | ↓ | 60000 | 400 | 42 | 21 | 4 | 23 | 1.1 | 2.09 |
| 86 | 5 | — | 0.6 | — | — | — | <0.05 | Balance | 17 | 480:4 | 60000 | 400 | 22 | 20 | 5 | 26 | 1.3 | 2.11 |
| 87 | 5 | — | — | 0.03 | — | — | <0.05 | Balance | 17 | 540:48 | 60000 | 400 | 95 | 30 | 2 | 32 | 1.1 | 2.13 |
| 88 | 5 | — | — | 0.1 | — | — | <0.05 | Balance | 17 | ↓ | 60000 | 400 | 62 | 34 | 0 | 34 | 1.0 | 2.15 |
| 89 | 5 | — | — | 0.3 | — | — | <0.05 | Balance | 17 | 470:4 | 60000 | 400 | 35 | 33 | 2 | 35 | 1.1 | 2.13 |
| 90 | 5 | — | — | — | 0.03 | — | <0.05 | Balance | 17 | 530:48 | 60000 | 400 | 98 | 29 | 3 | 33 | 1.1 | 2.12 |
| 91 | 5 | — | — | — | 0.1 | — | <0.05 | Balance | 17 | ↓ | 60000 | 400 | 67 | 30 | 2 | 31 | 1.0 | 2.13 |
| 92 | 5 | — | — | — | 0.3 | — | <0.05 | Balance | 17 | 460:4 | 60000 | 400 | 21 | 30 | 3 | 34 | 1.1 | 2.12 |
| 93 | 5 | — | — | — | — | 0.2 | <0.05 | Balance | 17 | 500:48 | 60000 | 400 | 86 | 27 | 4 | 32 | 1.2 | 2.10 |
| 94 | 5 | — | — | — | — | 0.5 | <0.05 | Balance | 17 | ↓ | 60000 | 400 | 80 | 25 | 5 | 29 | 1.2 | 2.08 |
| 95 | 5 | — | — | — | — | 1.0 | <0.05 | Balance | 17 | 450:4 | 60000 | 400 | 66 | 24 | 3 | 30 | 1.3 | 2.07 |
| 96 | 5 | 0.1 | 0.4 | — | — | — | <0.05 | Balance | 17 | 520:16 ↓ | 60000 | 400 | 31 | 22 | 3 | 28 | 1.3 | 2.13 |
| 97 | 5.5 | 0.1 | 0.05 | 0.05 | — | 0.3 | <0.05 | Balance | 17 | 480:4 | 60000 | 400 | 35 | 20 | 1 | 36 | 1.8 | 2.17 |

*Grain size was measured on a face normal to the rolling plane and parallel to the rolling direction by linear intercept method.
**Orientations of 100 grains were determined by electron channeling pattern method.

TABLE 7

Composition, processing conditions, grain size*, crystallographic texture** and limiting drawing ratios for comparative samples

| | Composition (% by weight) | | | | | | | | Processing conditions | | | | | Crystallographic texture component (volume %) | | | | |
|---|---|---|---|---|---|---|---|---|---|---|---|---|---|---|---|---|---|---|
| No | Mg | Fe | Mn | Cr | Zr | Cu | Si | Al | Final roll reduction (%) | Homogenization conditions (temp: hours) | Heating rate (° C.) | Anneal process temperature (° C.) | Average grain size (μm) | CUBE | GOSS | S | S/CUBE | Assessment LDR |
| 98 | 1.5 | 0.2 | — | — | — | — | <0.05 | Balance | 17 | 500:4 | 60000 | 400 | 103 | 27 | 5 | 33 | 1.2 | 1.88 orange peel |
| 99 | 6.5 | 0.1 | — | — | — | — | <0.05 | Balance | 17 | 500:4 | 60000 | 400 | 80 | 33 | 5 | 29 | 0.9 | 2.01 |
| 100 | 5 | 0.02 | — | — | — | — | <0.05 | Balance | 17 | 500:4 | 60000 | 400 | 153 | 33 | 4 | 34 | 1.0 | 2.08 orange peel |
| 101 | 5 | 0.25 | — | — | — | — | <0.05 | Balance | 17 | 500:4 | 60000 | 400 | 63 | 36 | 4 | 30 | 0.8 | 2.01 |
| 102 | 5 | — | 0.02 | — | — | — | <0.05 | Balance | 17 | 500:4 | 60000 | 400 | 110 | 21 | 6 | 24 | 1.1 | 2.00 orange peel |
| 103 | 5 | — | 0.7 | — | — | — | <0.05 | Balance | 17 | 500:4 | 60000 | 400 | 16 | 18 | 4 | 26 | 1.4 | 2.02 ss mark |
| 104 | 5 | — | — | 0.02 | — | — | <0.05 | Balance | 17 | 500:4 | 60000 | 400 | 108 | 31 | 4 | 33 | 1.1 | 2.08 orange peel |
| 105 | 5 | — | — | 0.4 | — | — | <0.05 | Balance | 17 | 500:4 | 60000 | 400 | 17 | 29 | 3 | 36 | 1.2 | 2.10 ss |

TABLE 7-continued

Composition, processing conditions, grain size*, crystallographic texture** and limiting drawing ratios for comparative samples

| No | Composition (% by weight) Mg | Fe | Mn | Cr | Zr | Cu | Si | Al | Processing conditions: Final roll reduction (%) | Homogenization conditions (temp: hours) | Heating rate (° C.) | Anneal process temperature (° C.) | Average grain size (μm) | Crystallographic texture component (volume %) CUBE | GOSS | S | S/CUBE | Assessment LDR |
|---|---|---|---|---|---|---|---|---|---|---|---|---|---|---|---|---|---|---|
| 106 | 5 | — | — | — | 0.02 | — | <0.05 | Balance | 17 | 500:4 | 60000 | 400 | 105 | 27 | 4 | 35 | 1.3 | mark 2.06 |
| 107 | 5 | — | — | — | 0.4 | — | <0.05 | Balance | 17 | 500:4 | 60000 | 400 | 18 | 31 | 5 | 35 | 1.1 | orange peel 2.10 |
| 108 | 5 | — | — | — | — | 0.1 | <0.05 | Balance | 17 | 500:4 | 60000 | 400 | 91 | 32 | 7 | 28 | 0.9 | ss mark 1.96 |
| 109 | 5 | — | — | — | — | 1.1 | <0.05 | Balance | 17 | 500:4 | 60000 | 400 | 60 | 22 | 6 | 33 | 1.5 | 1.99 |
| 110 | 5 | — | 0.4 | — | — | — | <0.05 | Balance | 80 | 500:4 | 60000 | 530 | 50 | 35 | 6 | 7 | 0.2 | 2.00 |
| 111 | 5 | — | — | — | 0.1 | — | <0.05 | Balance | 80 | 500:4 | 60000 | 530 | 62 | 42 | 7 | 8 | 0.2 | 1.88 |
| 112 | 5 | 0.1 | 0.4 | — | — | — | <0.05 | Balance | 50 | 500:4 | 300 | 530 | 55 | 13 | 8 | 9 | 0.7 | 1.94 |
| 113 | 5.5 | 0.1 | 0.05 | 0.05 | — | 0.3 | <0.05 | Balance | 50 | 500:4 | 3000 | 530 | 53 | 13 | 9 | 7 | 0.5 | 1.98 |

*Grain size was measured on a face normal to the rolling plane and parallel to the rolling direction by linear intercept method.
**Orientations of 100 grains were determined by electron channeling pattern method.

The LDR values for the examples of the present invention (Table 6) were all 2.08 or higher while, for the comparative examples, the LDR values were 2.01 or less or, in cases where the LDP was larger than 2.02, orange peel or stretcher strain marks (ss marks) were observed. Therefore, the samples of the present invention exhibited better drawing performance.

EXAMPLE 6

The alloys shown in Tables 8 and 9 were prepared by first casting DC ingots with the following dimensions: 400 mm (width)×150 mm (thickness)×3000 mm (length). After homogenization using the conditions shown in Tables 8 and 9, the ingots were hot rolled to a thickness of 5 mm. The initial temperature employed during hot rolling was the same as that used during the second step of the homogenization practice. The final temperature measured during hot rolling was about 150° C. lower than the initial hot rolling temperature mentioned above. Following hot rolling, the sheet was cold rolled to a thickness of 5 mm. During the intermediate stages of cold rolling, intermediate annealing was conducted appropriately to adjust the final cold rolling reductions to 17% and 50%. Samples were also cold rolled with no intermediate annealing to get a final cold rolling reduction of 80%. The sheet materials were then annealed/heat treated at 530° C. The resulting grain sizes and textures of the samples (Nos. 121–153) are shown in Tables 8 and 9. Furthermore, the heat-up rates to the anneal temperature were either rapid heating (60,000° C./h) or slow (300° C./h).

The resulting sheet materials (Nos. 121 to 153) were deformed in uniaxial and plane strain tension tests using appropriate specimens, in the same fashion as described in the Example 3. The fracture strain results of these tests are shown in Tables 8 and 9, together with the production process parameters (final cold rolling reduction, homogenization process temperature and retention time, heating rate), grain sizes and textures. Table 8 shows the results of the examples of the current invention and Table 9 shows the results of the comparative examples.

TABLE 8

Composition, processing conditions, grain size* and crystallographic texture** of samples which result in good formability in uniaxial tension and plane strain tension

| No. | Composition (% by weight) Mg | Fe | Mn | Cr | Zr | Cu | Si | Al | Processing conditions: Final roll reduction (%) | Homogenization conditions (temp:hours) | Heating rate (° C./hour) | Average grain size (μm) | Crystallographic texture component (volume %) CUBE | BRASS | Fracture strain: Uniaxial tension | Plane strain tension |
|---|---|---|---|---|---|---|---|---|---|---|---|---|---|---|---|---|
| 121 | 2 | 0.2 | — | — | — | — | <0.05 | Balance | 80 | 500:48 | 60000 | 69 | 37 | 11 | 0.35 | 0.30 |
| 122 | 3 | 0.1 | — | — | — | — | <0.05 | Balance | 80 | ↓ | 60000 | 70 | 44 | 12 | 0.36 | 0.31 |

TABLE 8-continued

Composition, processing conditions, grain size* and crystallographic texture** of samples which result in good formability in uniaxial tension and plane strain tension

| | Composition (% by weight) | | | | | | | | Processing conditions | | | | | | Fracture strain | |
|---|---|---|---|---|---|---|---|---|---|---|---|---|---|---|---|---|
| | | | | | | | | | Final roll reduction | Homogenization conditions | Heating rate | Average grain size | Crystallographic texture component (volume %) | | Uniaxial tension | Plane strain tension |
| No. | Mg | Fe | Mn | Cr | Zr | Cu | Si | Al | (%) | (temp:hours) | (° C./hour) | (μm) | CUBE | BRASS | | |
| 123 | 6 | 0.03 | — | — | — | — | <0.05 | Balance | 80 | 420:4 | 60000 | 68 | 46 | 13 | 0.37 | 0.32 |
| 124 | 5 | — | 0.03 | — | — | — | <0.05 | Balance | 80 | 530:48 | 60000 | 69 | 38 | 12 | 0.36 | 0.31 |
| 125 | 5 | — | 0.2 | — | — | — | <0.05 | Balance | 80 | ↓ | 60000 | 61 | 42 | 14 | 0.36 | 0.31 |
| 126 | 5 | — | 0.6 | — | — | — | <0.05 | Balance | 80 | 460:4 | 60000 | 50 | 44 | 20 | 0.35 | 0.30 |
| 127 | 5 | — | — | 0.03 | — | — | <0.05 | Balance | 80 | 520:48 | 60000 | 68 | 37 | 11 | 0.37 | 0.32 |
| 128 | 5 | — | — | 0.1 | — | — | <0.05 | Balance | 80 | ↓ | 60000 | 60 | 41 | 12 | 0.37 | 0.32 |
| 129 | 5 | — | — | 0.3 | — | — | <0.05 | Balance | 80 | 450:4 | 60000 | 52 | 45 | 18 | 0.36 | 0.31 |
| 130 | 5 | — | — | — | 0.03 | — | <0.05 | Balance | 80 | 510:48 | 60000 | 66 | 35 | 16 | 0.38 | 0.33 |
| 131 | 5 | — | — | — | 0.1 | — | <0.05 | Balance | 80 | ↓ | 60000 | 62 | 38 | 12 | 0.37 | 0.32 |
| 132 | 5 | — | — | — | 0.3 | — | <0.05 | Balance | 80 | 460:4 | 60000 | 54 | 49 | 10 | 0.37 | 0.32 |
| 133 | 5 | — | — | — | — | 0.2 | <0.05 | Balance | 80 | 490:24 | 60000 | 68 | 42 | 11 | 0.36 | 0.31 |
| 134 | 5 | — | — | — | — | 0.5 | <0.05 | Balance | 80 | ↓ | 60000 | 67 | 44 | 12 | 0.36 | 0.31 |
| 135 | 5 | — | — | — | — | 1.0 | <0.05 | Balance | 80 | 430:4 | 60000 | 61 | 44 | 11 | 0.36 | 0.31 |
| 136 | 5 | 0.1 | 0.4 | — | — | — | <0.05 | Balance | 80 | 500:16 ↓ | 60000 | 55 | 40 | 10 | 0.36 | 0.31 |
| 137 | 5.5 | 0.1 | 0.05 | 0.05 | — | 0.3 | <0.05 | Balance | 80 | 450:4 | 60000 | 53 | 36 | 13 | 0.37 | 0.32 |

*Grain size was measured on a face normal to the rolling plane and parallel to the rolling direction by linear intercept method.
**Orientations of 100 grains were determined by electron channeling pattern method.

TABLE 9

Composition, processing conditions, grain size*, crystallographic texture** and failure strains in uniaxial tension and plane strain tension for comparative samples

| | Composition (% by weight) | | | | | | | | Processing conditions | | | | | | Fracture strain | |
|---|---|---|---|---|---|---|---|---|---|---|---|---|---|---|---|---|
| | | | | | | | | | Final roll reduction | Homogenization conditions | Heating rate | Average grain size | Crystallographic texture component (volume %) | | Uniaxial tension | Plane strain tension |
| No | Mg | Fe | Mn | Cr | Zr | Cu | Si | Al | (%) | (temp:hours) | (° C./hour) | (μm) | CUBE | BRASS | | |
| 138 | 1.5 | 0.2 | — | — | — | — | <0.05 | Balance | 80 | 500:4 | 60000 | 68 | 53 | 18 | 0.32 | 0.27 |
| 139 | 6.5 | 0.1 | — | — | — | — | <0.05 | Balance | 80 | 500:4 | 60000 | 57 | 44 | 22 | 0.33 | 0.28 |
| 140 | 5 | 0.02 | — | — | — | — | <0.05 | Balance | 80 | 500:4 | 60000 | 103 | 44 | 18 | 0.34 | 0.29 orange peel |
| 141 | 5 | 0.25 | — | — | — | — | <0.05 | Balance | 80 | 500:4 | 60000 | 49 | 36 | 10 | 0.32 | 0.27 |
| 142 | 5 | — | 0.02 | — | — | — | <0.05 | Balance | 80 | 500:4 | 60000 | 107 | 34 | 11 | 0.34 | 0.29 orange peel |
| 143 | 5 | — | 0.7 | — | — | — | <0.05 | Balance | 80 | 500:4 | 60000 | 37 | 42 | 18 | 0.31 | 0.26 |
| 144 | 5 | — | — | 0.02 | — | — | <0.05 | Balance | 80 | 500:4 | 60000 | 103 | 32 | 17 | 0.34 | 0.29 orange peel |
| 145 | 5 | — | — | 0.4 | — | — | <0.05 | Balance | 80 | 500:4 | 60000 | 35 | 38 | 12 | 0.31 | 0.26 |
| 146 | 5 | — | — | — | 0.02 | — | <0.05 | Balance | 80 | 500:4 | 60000 | 105 | 33 | 11 | 0.34 | 0.29 orange peel |
| 147 | 5 | — | — | — | 0.4 | — | <0.05 | Balance | 80 | 500:4 | 60000 | 41 | 47 | 16 | 0.32 | 0.27 |
| 148 | 5 | — | — | — | — | 0.1 | <0.05 | Balance | 80 | 500:4 | 60000 | 107 | 40 | 15 | 0.33 | 0.28 orange peel |
| 149 | 5 | — | — | — | — | 1.1 | <0.05 | Balance | 80 | 500:4 | 60000 | 55 | 42 | 17 | 0.27 | 0.22 |
| 150 | 5 | — | 0.4 | — | — | — | <0.05 | Balance | 50 | 500:4 | 60000 | 31 | 9 | 2 | 0.29 | 0.24 |
| 151 | 5 | — | — | — | 0.1 | — | <0.05 | Balance | 50 | 500:4 | 60000 | 40 | 14 | 5 | 0.31 | 0.26 |
| 152 | 5 | 0.1 | 0.4 | — | — | — | <0.05 | Balance | 17 | 500:4 | 300 | 66 | 28 | 7 | 0.32 | 0.27 |
| 153 | 5.5 | 0.1 | 0.05 | 0.05 | — | 0.3 | <0.05 | Balance | 17 | 500:4 | 300 | 72 | 32 | 3 | 0.33 | 0.28 |

*Grain size was measured on a face normal to the rolling plane and parallel to the rolling direction by linear intercept method.
**Orientations of 100 grains were determined by electron channeling pattern method.

The fracture strains for the samples corresponding to the current invention were 0.35 or more in uniaxial tension, while they were 0.30 or more in plane strain tension (Table 8). Conversely, the fracture strains measured in uniaxial tension were less than 0.35 for the comparative samples while they were less than 0.30 in plane strain tension (Table 9), and orange peel was observed on the surface of five of these comparative samples. Therefore, the samples corresponding to the current invention exhibit better stretchability in plane strain and uniaxial tension modes of deformation.

What is claimed is:

1. An Al—Mg, based alloy sheet characterlized by good press formability, containing Mg in a range of about 2 to 6 wt. % and at least one element selected from Fe, Mn, Cr or Zr at 0.03 wt. % or more in total, the upper limit of each element being Fe≦about 0.1 wt. %, Mn≦about 0.6 wt. %, Cr≦about 0.3 wt. % and Zr≦about 0.3 wt. %, comprising a texture with a ratio (S/Cube) of the volume fraction in the S orientation {123}<634> to the volume fraction in the CUBE orientation {100}<001> being 1 or more, a volume fraction of about 4% or less in the GOSS orientation {110}<001>, and a volume fraction of about 28% or more in the S orientation, wherein the grain size is in a range of about 20 to 100 $\mu$m.

2. The Al—Mg based alloy sheet according to claim 1 containing Cu in a range of about 0.2 to 1.0 wt %.

* * * * *